US006923386B2

(12) United States Patent
Bonzer

(10) Patent No.: US 6,923,386 B2
(45) **Date of Patent: *Aug. 2, 2005**

(54) TWO-WAY WATER SHUT-OFF NOZZLE

(75) Inventor: Robert L. Bonzer, Boise, ID (US)

(73) Assignee: Bon-Aire Industries, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/346,805

(22) Filed: Jan. 16, 2003

(65) Prior Publication Data

US 2004/0050969 A1 Mar. 18, 2004

Related U.S. Application Data

(63) Continuation-in-part of application No. 10/243,209, filed on Sep. 12, 2002, now Pat. No. 6,561,439.

(51) Int. Cl.[7] ..... B05B 1/32

(52) U.S. Cl. ..... 239/458; 239/451; 239/456; 239/460

(58) Field of Search ..... 239/451, 456, 239/458, 460, 452–455, 457, 515, 569–571, 579

(56) References Cited

U.S. PATENT DOCUMENTS

| | | | | |
|---|---|---|---|---|
| 583,135 | A | 5/1897 | Wilson | |
| RE21,469 | E | 5/1940 | Stein | |
| 2,331,741 | A | 10/1943 | Smith | |
| 2,474,332 | A | 6/1949 | Sciuto | |
| 2,560,278 | A | 7/1951 | Curtis | |
| 2,944,742 | A | 7/1960 | Blanc | |
| 2,991,016 | A * | 7/1961 | Allenbaugh, Jr. | 239/458 |
| 3,001,725 | A | 9/1961 | Lockett | |
| 3,042,318 | A | 7/1962 | Chow et al. | |
| 3,045,927 | A | 7/1962 | Gilmour | |
| 3,102,691 | A | 9/1963 | Gall | |
| 3,219,278 | A | 11/1965 | Santarelli | |
| 3,494,561 | A | 2/1970 | Buehler | |
| 3,502,270 | A | 3/1970 | Prencipe | |
| 3,539,112 | A | 11/1970 | Thompson | |
| 3,746,262 | A | 7/1973 | Bete et al. | |
| 4,095,749 | A | 6/1978 | Campbell | |
| 4,342,426 | A | 8/1982 | Gagliardo | |
| 4,465,235 | A | 8/1984 | Allenbaugh, Jr. | |
| 4,717,073 | A | 1/1988 | Bielka | |
| 4,840,313 | A | 6/1989 | Hansen | |
| 5,551,635 | A | 9/1996 | Jager | |
| 5,556,037 | A | 9/1996 | Wood | |
| 5,685,489 | A | 11/1997 | Larsen | |
| 5,823,435 | A | 10/1998 | Morgan et al. | |
| 5,833,143 | A | 11/1998 | Hsin-Fa | |
| 6,036,117 | A | 3/2000 | Heren et al. | |
| D451,981 | S | 12/2001 | Ericksen | |

* cited by examiner

*Primary Examiner*—David A. Scherbel
*Assistant Examiner*—Darren Gorman
(74) *Attorney, Agent, or Firm*—Frank J. Dykas; Dykas, Shaver & Nipper

(57) ABSTRACT

A dual closure nozzle for use with a hose carrying a liquid under pressure. The dual closure nozzle is made up of an inner delivery conduit attached to an end cap and threaded within an outer sleeve having a nozzle head. The dual closure nozzle is configured to have two different stop positions and to be adjustable between these two stop positions and a variety of open positions. When a liquid is forced through the nozzle, the flow of the liquid can then be adjusted from a first stop position, where no liquid passes out of the nozzle, through a variety of open position spray patterns to a second stop position. This configuration thus provides a nozzle that can be closed by turning the outer sleeve portion of the nozzle in either of two directions, and prevents spray from wetting the person utlizing the device.

6 Claims, 9 Drawing Sheets

TWO-WAY WATER SHUT-OFF NOZZLE

PRIORITY

This application is a continuation in part of an application Ser. No. 10/243,209 entitled Dual Closure Nozzle, filed by Robert Bonzer on Sep. 12, 2002, now U.S. Pat. No. 6,561, 439. The contents of both applications are incorporated herein by reference.

BACKGROUND OF THE INVENTION

1. Field of the Invention

The present invention generally relates to nozzles that direct and control delivery of a material from a source, and more particularly to rotary barrel adjustable water hose nozzles that are moveable from a closed position to an open position and again to a closed position.

2. Background Information

A variety of adjustable nozzles exist that are used to control and direct the delivery of a material from a source. Liquid materials are often carried under pressure from a source through a carrier such as a hose or conduit. Many times the delivery of the liquid from the hose or conduit to an intended location is accomplished through a nozzle. Common types of nozzles include fire hose nozzles, garden nozzles, washing nozzles, and other types of nozzles. Nozzles are generally configured to perform an intended function. For example, a fire hose must be able to direct desired amounts of water in desired patterns under various pressures depending upon the specific necessities of the user. A garden hose nozzle may be configured to produce a light spray for watering delicate flowers and plants, as well as to deliver a heavier stream of water for washing sidewalks or other surfaces. A washer type nozzle may need to be able to deliver various pressures and amounts of water depending upon the requirements of the situation at hand. Some nozzles are configured to provide a continuous delivery of material through the nozzle, while others are configured to be adjustable from an open position, where material flows out of the nozzle, to a closed position, where material is prevented from leaving through the nozzle.

One common configuration of a nozzle provides an inner portion and an outer portion moveably interconnected by a threaded means that allows the outer portion of the nozzle to twist about the inner portion. These two portions are generally configured so that when the threaded means are engaged, the outer portion is moveable from a position where the inner portion and the outer portion are in a form of compressive engagement, or to a position where this compressive engagement is relaxed. In most cases, when the inner portion and the outer portion are positioned in compressive engagement, material cannot leave the nozzle. As this compressive engagement is relaxed, the nozzle begins to open and material is then able to pass out of the nozzle. Depending upon the configuration and structure of the portions of the nozzle, the patterns, amounts, velocities, and pressures of the liquid leaving the nozzle can vary.

In many applications, twisting or adjusting the nozzle away from the closed position generally functions to increase the amount of material flowing out of the nozzle. Depending upon the specific configuration of the nozzle, this adjustment may decrease the amount of spray from the nozzle and increase the amount of liquid that flows directly out of the nozzle in a stream of flow. This opening movement will generally stop at a position where a maximum amount of flow out of the nozzle will occur. In these same types of embodiments, twisting the outer portion of the nozzle in a manner that compresses the inner and outer portions of the nozzle will cause the direct flow from the nozzle to be decreased and the spray pattern to be increased. As this compressive movement continues, the inner and outer portions of the nozzle will generally engage and compress. As this compression occurs, the flow of liquid through the nozzle will be reduced and eventually shut off.

While this type of nozzle is useful in many applications, it also has some distinct disadvantages. First, because only one closed position exists, several turns of the outer portion of the nozzle are required to adjust the flow of the liquid and to turn the nozzle off and on. This structure also requires that to adjust the delivery of liquid out of the nozzle, the outer portion must be twisted or otherwise adjusted through all of the various dispersion patterns until arriving at a position where the nozzle is closed. Some of these nozzles also have a tendency to leak, provide irregular dispersal patterns, and may be awkward and/or difficult to use.

Another disadvantage of many of these types of nozzles is that the inner and outer portions are configured so that when the inner and outer portions of the nozzle are moved from an open position towards a closed position, the spray pattern of the material leaving the nozzle becomes wider and finer. This is particularly true in embodiments where closure of the nozzle is accomplished by an end cap. These spray patterns can become so fine and so wide that the person holding the nozzle can actually become wet from the spray. While in some instances such as fire suppression or fire fighting such a result is desired, in many other instances the person utilizing the nozzle prefers not to become wet, and therefore a nozzle that prevents the spray from wetting the persons holding the nozzle while the nozzle is being closed is desired.

Therefore, it is an object of this invention to provide an adjustable nozzle, which allows for flow of liquid through the nozzle to be stopped at two different nozzle positions. It is also an object of this invention to provide a nozzle, which opens and closes by turning a portion of the nozzle in a clockwise or counterclockwise direction. It is a further object of the invention to provide a water shut off nozzle with increased ease of use. It is a further object of the invention to provide a water shut off nozzle that has all of the aforementioned advantages with a handle and nozzle head that directs the spray from the nozzle in a desired direction and prevents the user of the nozzle from being wetted from lateral spray dispersal.

Additional objects, advantages and novel features of this invention will be set forth in part in the description as follows and in part-will become apparent to those skilled in the art upon examination of the following, or may be learned by practice of the invention. The objects and advantages of the invention are to be realized and obtained by the means of the instrumentalities and combinations particularly pointed out in the appended claims.

SUMMARY OF THE INVENTION

The present invention is a dual closure nozzle for use with a hose carrying a liquid under pressure. The nozzle is configured so that the nozzle can be moved from a first closed position through a variety of open positions to a second closed position. The nozzle is also configured so that the nozzle prevents unwanted back spray of liquid upon a user. In one embodiment of the invention, the dual closure nozzle is made up of an outer sleeve threadedly connected around an inner delivery conduit.

The outer sleeve has an opening at a receiving end for receiving the inner conduit and an opening at a second end for allowing discharge of a fluid material therefrom. A bore extends from the receiving end to the discharge end and is configured to receive an inner conduit therein. Within the outer sleeve, a first sealing race and a second sealing race circumvolve the bore. The first sealing race is disposed within the bore closer to the receiving end and the second sealing race is disposed closer to the discharge end of the bore. A campanulate handle having a generally hollow fossa is connected to the outer surface of the outer sleeve and is positioned so that discharge opening of the outer sleeve is positioned at the deepest portion of the internal fossa of the handle.

The inner conduit is configured for insertion within the receiving end of the outer sleeve, and extends within the bore. The inner conduit has an inlet opening configured for the passage of fluid material from an external source such as a garden hose into the inner sleeve and at least one outlet for the passage of the fluid material out from the inner conduit and into the outer sleeve. A first sealing means is located between the outer sleeve and the inner conduit and is configured to prevent the passage of fluid material out from the outer sleeve through the opening at the discharge end. A second sealing means is also located between the inner conduit and the outer sleeve, and is configured to prevent the passage of fluid material out from the outer sleeve through the opening at the receiving end. The inner conduit and the outer conduit are held together by a threaded connection means which allows the outer sleeve to be displaced longitudinally by twisting the outer sleeve about the inner conduit.

In one embodiment of the invention, the nozzle is configured so that when the outer sleeve and inner conduit are configured in a first closed position, the first sealing means is in fluid tight engagement with the second sealing race. Twisting the outer sleeve about the inner conduit causes the outer sleeve to move longitudinally along the inner conduit. As this outer sleeve moves longitudinally along the inner conduit, the device moves from this first closed position through a variety of open positions to a second closed position. At this second closed position, the first sealing means is in fluid tight engagement with the first sealing race.

In another embodiment of the invention, the inner conduit has an end cap connected to an end of the conduit located distally from the inlet opening. The end cap is configured for fluid tight engagement with the second sealing race. In this embodiment, when the outer sleeve is rotated, the threaded portions move the outer sleeve longitudinally from a first closed position wherein the first sealing means is in fluid tight engagement with the second sealing race through a variety of open positions to a second closed position wherein the end cap is positioned in fluid tight engagement with the second sealing race.

As the inner conduit is moved toward the second closed position where the end cap is placed in fluid tight engagement with the second sealing race, lateral spray from the outer portions of the nozzle are directed by the inner walls of the handle toward a collecting point where the spray collects and falls downward. This prevents the person holding the nozzle from being sprayed by the water and from becoming wet.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
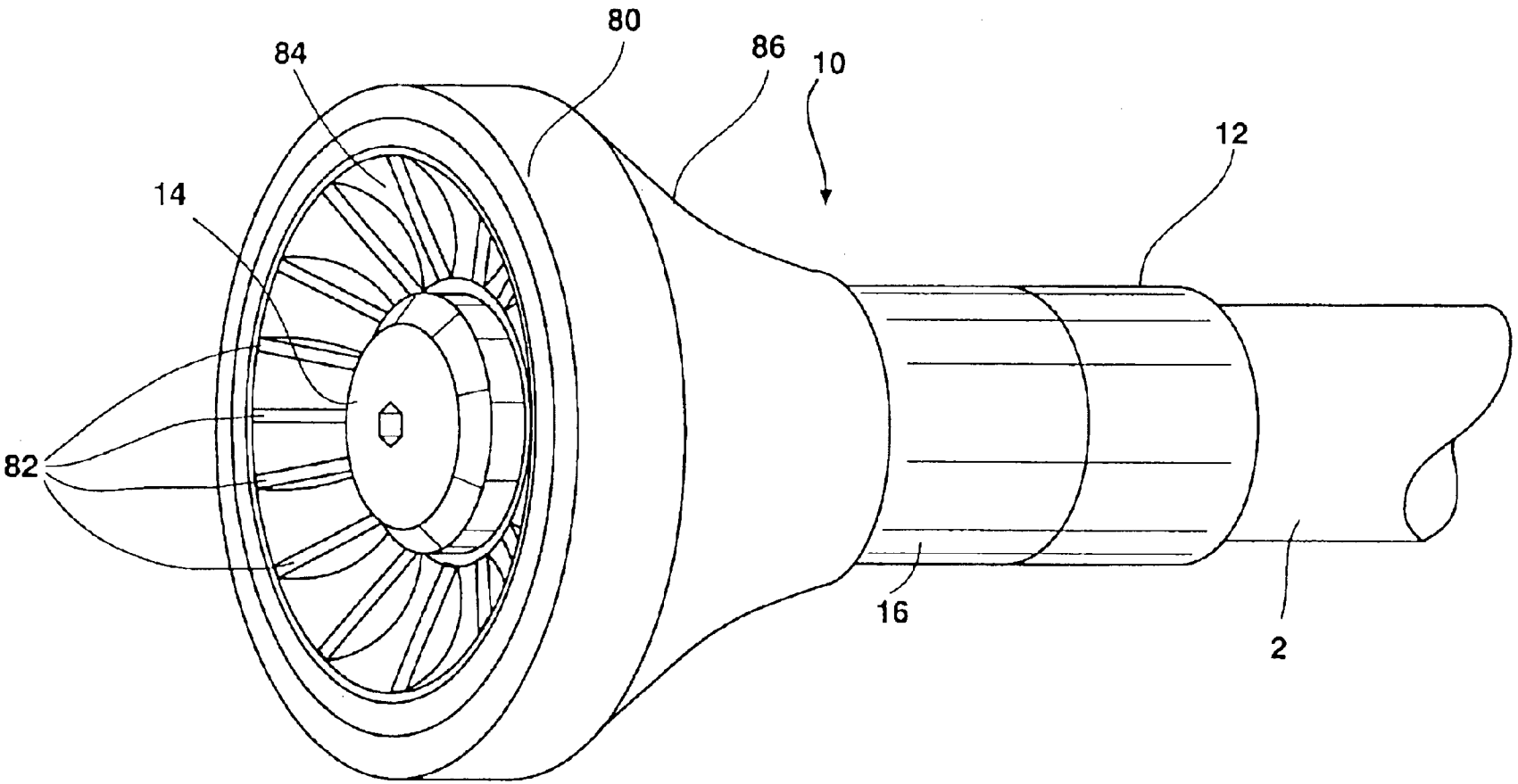
FIG. 1 is a perspective view of a first embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a dual closure nozzle that provides regulation of the flow of a liquid out of a hose. The dual closure nozzle provides two means for stopping the flow of the liquid through the nozzle. This enables the party utilizing the nozzle to twist the nozzle in one direction and in so doing change the flow of the liquid through the nozzle from a closed position, where no liquid leaves the nozzle, to a variety of open positions which provide a variety of spray patterns, to another closed position. While in this embodiment the invention is described in use with a garden type hose that carries water under pressure, it is to be distinctly understood that the features of the invention are not limited to this use, but may be used in any application wherein a nozzle with the disclosed capabilities is desired. This disclosure should therefore be seen as illustrative in nature and not as restrictive.

Referring now to FIGS. 1–6, a first embodiment of the present invention is shown. FIG. 1 is a perspective view of the first embodiment of the present invention. The dual closure nozzle 10 comprises an inner delivery conduit 12, moveably attached within an outer sleeve 16 by a connection means (shown in FIG. 2). The outer sleeve 16 is connected within a bell-shaped nozzle head 80. The nozzle head 80 has a variety of projections 82 which extend from the cupped inner surface 84 of the bell shaped nozzle head. In this embodiment, the inner conduit 12 has a portion adapted for connection with a hose 2, an end cap 14, and a series of fins (shown in FIG. 3) which assist to direct the flow and dispersal pattern of the fluid upon discharge from the outer sleeve 16.

Figure 2:
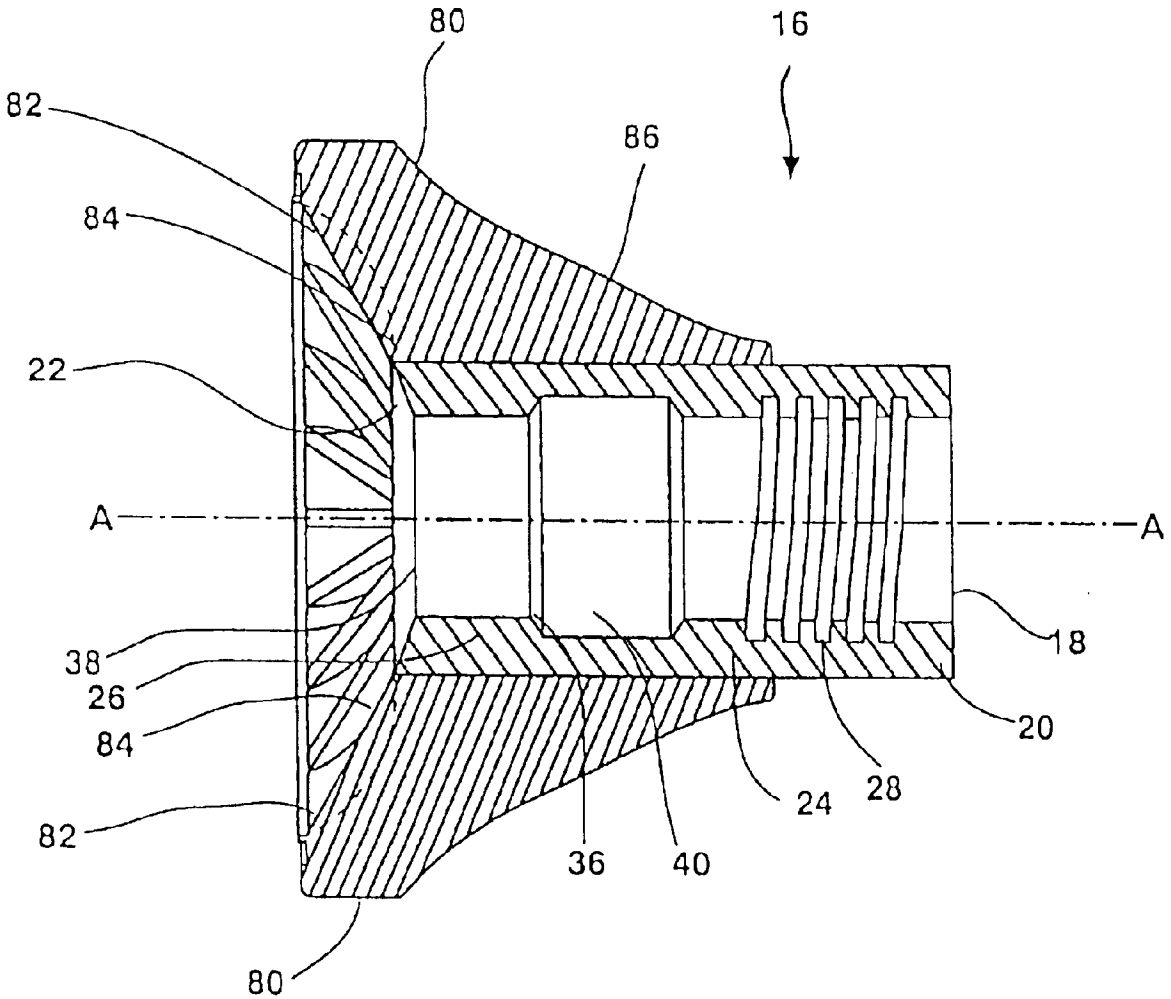
FIG. 2 is a detailed, cross-sectional side view of the outer sleeve portion of the present invention.

Referring now to FIG. 2, a detailed, cross-sectional side view of the outer sleeve 16 is shown. The outer sleeve 16 defines a bore 18 extending from an open first end 20 to an open second end 22 along an axis A—A. The open first end 20 and the bore 18 are configured to receive the inner conduit 12 therein. The open second end 22 forms a discharge opening which is configured to allow the passage of the fluid material therethrough.

The outer sleeve 16 has a handle portion or nozzle head 80 configured for manual grasping. In this embodiment, the nozzle head 80 is a generally bell shaped covering having an inner wall 84 which defines a fossa. The inner wall 84 has a series of projections 82 which extend from inner wall 84 and assist to break up a spray head which is formed by the aggregation of fine spray patterns as they extend from the discharge opening 22 of the outer sleeve 16. The nozzle head 80 is positioned so that the discharge opening 22 of the outer sleeve 16 is located at the deepest part of the fossa defined by the inner wall 84. This nozzle head 80 also has an outer surface 86 which serves as a handle or grasping portion and allows the user to more easily grasp and rotate the outer sleeve 16 about the inner conduit 12. The outer surface 86 may be variously embodied to assist the user in achieving this result, this includes providing a variety of surface types and surface projections which assist the individual to grasp and manipulate the outer sleeve 16.

The receiving end 20 of the outer sleeve 16 has a connection means 28 for connecting the outer sleeve 16 with the inner conduit 12. In this embodiment, the connection means 28 is a set of compatibly threaded circumvolving grooves that are located within the bore 18 and are configured to correspond with a set of correspondingly configured threaded ridges located upon the inner conduit (shown in FIG. 3). The combination of grooves and ridges allows the outer sleeve 16 to be held in a desired position and orientation with regard to the inner conduit 12. This also allows the outer sleeve 16 to be selectively longitudinally displaced in relation to the position of the inner conduit 12. While in this embodiment the connection means 28 is a pair of correspondingly configured threaded portions, this is not the only connection means envisioned by this invention. It is to be distinctly understood that any connection means may be used which would enable the outer sleeve 16 and the inner conduit 12 to be moveably connected, and would allow the outer sleeve 16 and the inner sleeve 12 to be held in a variety of desired longitudinal positions with regard to one another.

The outer sleeve 16 has a first circumvolving sealing race 24 spatially disposed within the bore at a desired distance from a second circumvolving sealing race 26. Both the first and the second circumvolving races 24, 26 are configured for fluid tight engagement with a sealing means (shown in FIG. 3). The sealing races 24, 26 define between them a flow chamber 40 within the bore 18. Each of these sealing races 24, 26 circumvolve the inner portions of the bore 18 and are configured to allow the inner conduit 12 to pass there through. Each of the first and second sealing races 24, 26 are also configured for fluid tight sealing engagement with a sealing means (shown in FIG. 3), in this embodiment, the second side 38 of the second sealing race 26 is configured for compressive leak tight engagement between the second sealing race 26 and a first side 70 of an end cap 14 (shown in FIG. 3). The first side 36 of the second sealing race 26 defines one of the sides of the flow chamber 40.

Figure 3:
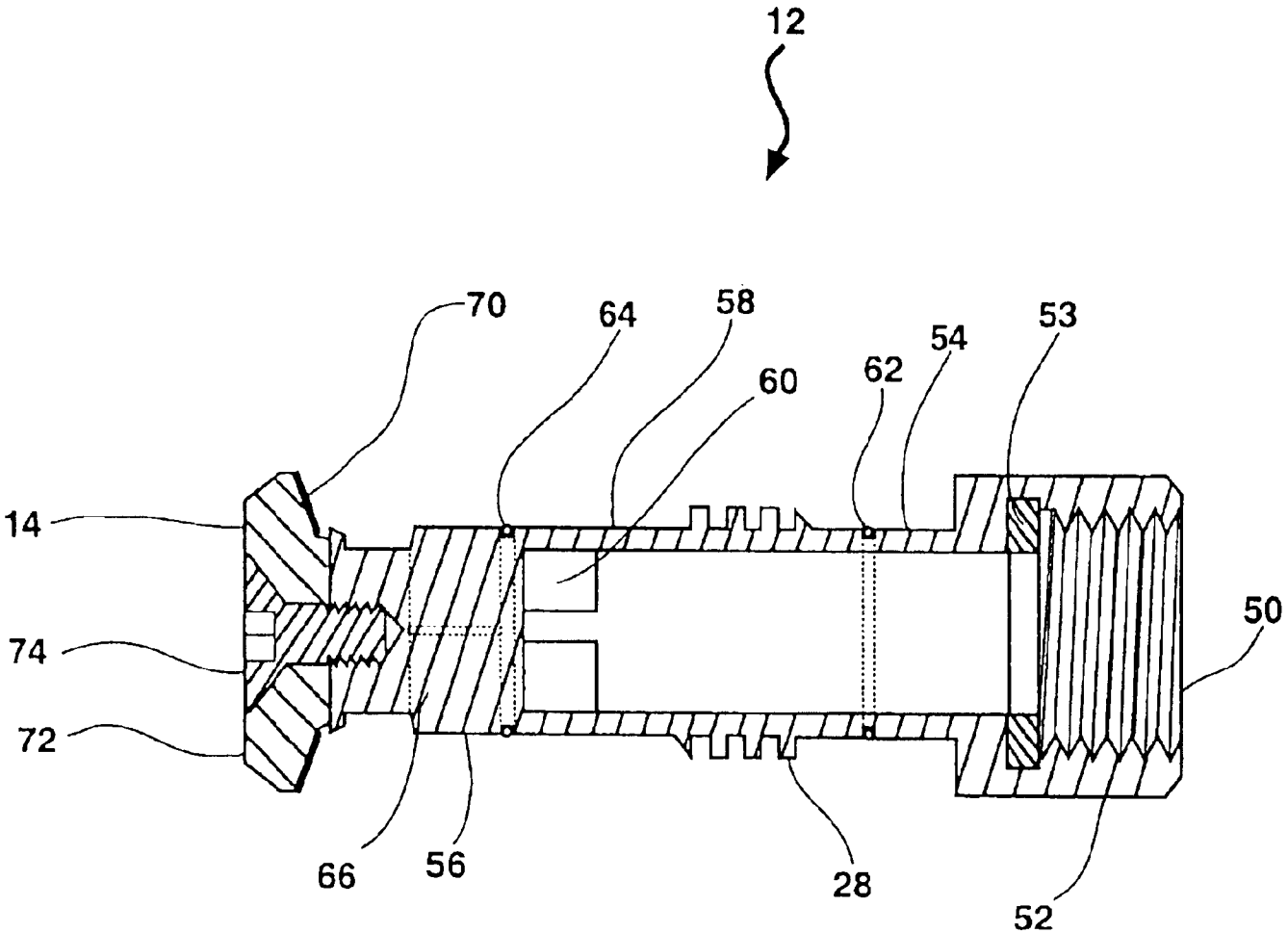
FIG. 3 is a detailed, cross-sectional side view of the inner conduit portion of the present invention.

Referring now to FIG. 3, a detailed, cross-sectional side view of the inner delivery conduit 12 is shown. The inner delivery conduit 12 has an open first end 50 with an attachment means 52 configured for connection to a source of pressurized liquid, such as a watering hose. While in this embodiment the inlet 50 that allows liquid to enter into the inner conduit is located at the first end 50 of the inner conduit 12, it is to be distinctly understood that such a location is merely illustrative and is not limiting. The inlet 50 for allowing fluid to enter into the chamber need not be located at an end but may be located in nearly any position along the inner conduit 12 as long as the inner and outer sleeve can be manipulated so as to achieve the ends and aims described in the present invention. This described structure of the present embodiment is therefore merely an illustrative embodiment of the present invention.

In this embodiment, the inlet 50 further comprises an attachment means 52. This attachment means 52 has a threaded portion with a sealing ring 53 that prevents liquid from leaking from the connection between the liquid source and the inner conduit 12. The configuration of the attachment means 52 is dependent upon the characteristics of the source to which the nozzle 10 is to be connected. Therefore, while in this embodiment a threaded means is shown, it is to be distinctly understood that any configuration may be used which achieves the desired result of connecting the inner conduit 12 to a source of a liquid under pressure, such as a hose.

The inner delivery conduit 12 extends from the open first end 50 along a hollow body 54 to a closed second end 56. The hollow body 54 has a portion 58 dimensioned for insertion within the bore 18 of the outer sleeve 16. The hollow body 54 insertion portion 58 has at least one outlet opening 60 therein. In this embodiment, four outlets 60 are located near the second end 56. These outlets 60 are configured to allow passage of the material out of the hollow body portion 54 of the inner conduit 12. In this embodiment, the inner conduit 12 is configured so that when combined with the outer sleeve 16, the outlets 60 of the inner conduit 12 are located generally within the expansion chamber 40 of the outer sleeve 16.

At least two sealing means 62, 64 are located between the outer sleeve 16 and the inner sleeve 12. In this embodiment, these sealing means are rubber O-rings 62, 64 circumvolving the hollow body 54. The first sealing means 62 circumscribes the hollow body 54 in a location along the hollow body 54 between the first end of the hollow body 50 and the outlets 60. The second O-ring 64 circumscribes the hollow body 54 at a location between outlets 60 and the second closed end 56 of the inner conduit. Each of the sealing means 62, 64 is configured for compressive leak tight engagement with the sealing races 24, 26 of the outer sleeve 16. While in this embodiment the sealing means 62, 64 are rubber O-rings, it is to be understood that any sealing means which is capable of providing a leak tight seal between the inner conduit 12 and the outer sleeve 16 may be used.

The closed second end 56 of the inner conduit 12 has a set of fins 66 that assists in directing the flow of water out of the nozzle 10. The closed end 56 of the inner conduit is also connected to an end cap 14. The end cap 14 has a first side 70 and a second side 72. The first side 70 is configured to form a compressive leak tight seal against the second side 38 of the second sealing race 26 when brought into compressive engagement against this side.

In this embodiment, the end cap 14 is connected to the closed end 56 of the inner conduit 12 by an end cap connecting means 74. The connecting means 74 for attaching the end cap 14 to the second end 56 is, in this embodiment, a threaded bolt with a flat head. While in this embodiment this means 74 is a threaded bolt with a flat head, it is to be distinctly understood that any means may be used to hold the end cap 14 against the second end 56 of the inner conduit 12.

Figure 4:
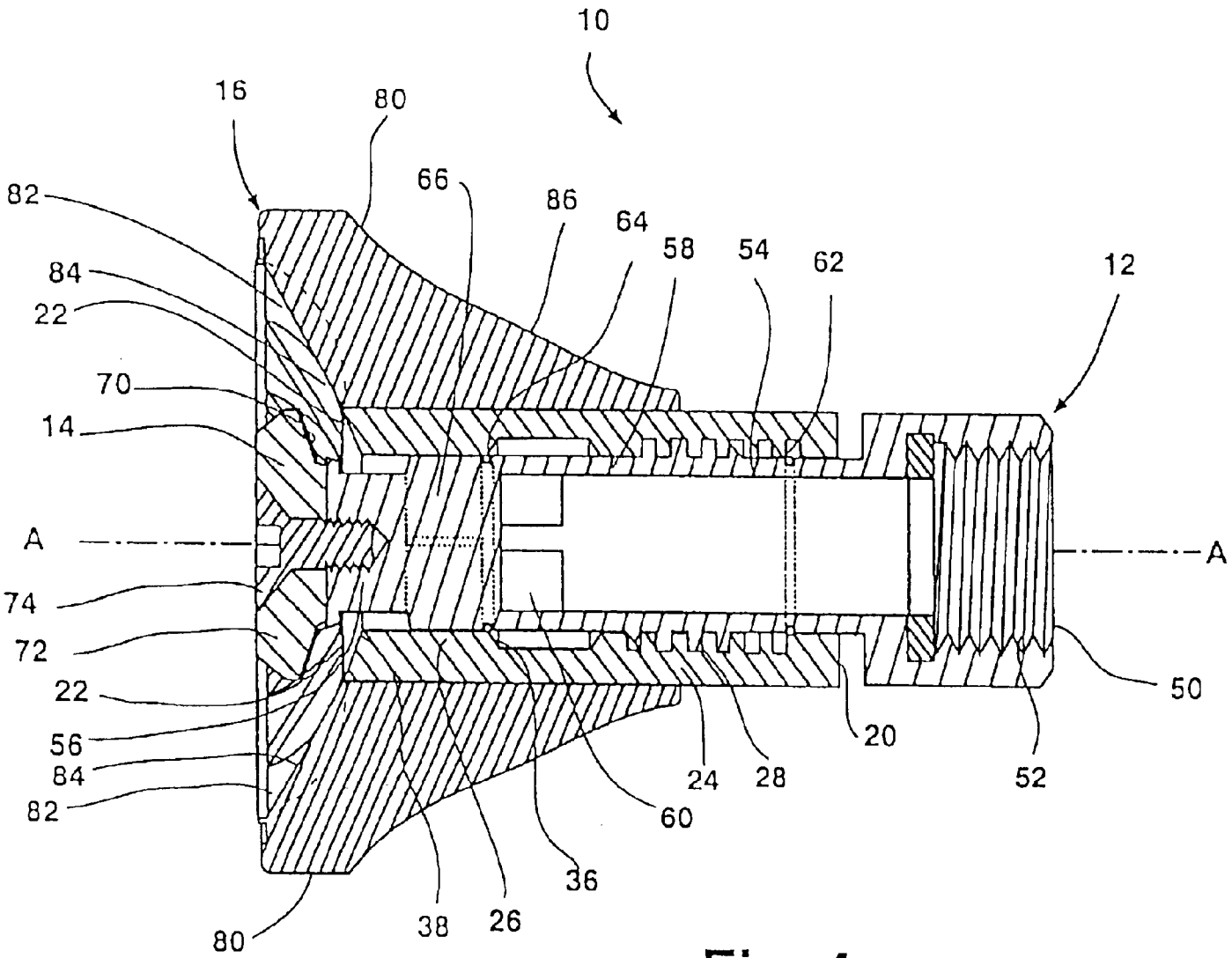
FIG. 4 is a detailed, cross-sectional side view of the embodiments of FIGS. 2 and 3 when the device is in a first closed position.

Referring now to FIG. 4, a detailed cross-sectional view of the nozzle 10 shown in FIG. 1 is shown. In this figure, the inner conduit 12 and the outer sleeve 16 are arranged in a first closed position. In this position, the hollow body portion 54 of the inner conduit 12 is located within the bore 18 of the outer sleeve 16 and the outer sleeve 16 and the inner conduit 12 are threadedly interconnected by the connection means 28. The inner conduit 12 is positioned so that the first sealing means 62 is in a compressive leak tight engagement against the first sealing race 24. This engagement prevents back flow of liquid material towards the receiving end 20 of the outer sleeve 16. The second sealing means 64 is placed in a compressive leak tight engagement against the second sealing race 26 thus preventing forward movement of material out of the discharge opening 22 of the outer sleeve 16. In this preferred embodiment, this second O-ring 64 is in a compressive engagement against the second sealing race 26. In this first closed position, liquids from the source enter the inner conduit 12 from the open first end 50, pass along through the hollow body 54, and are pushed out of the outlets 60 and into the outer sleeve 16. Upon leaving the outlets 60, the liquid is prevented from flowing out of the nozzle 10 by the compressive leak tight seals provided by the combinations of the sealing means 62, 64 and the sealing races 24, 26.

Figure 5:
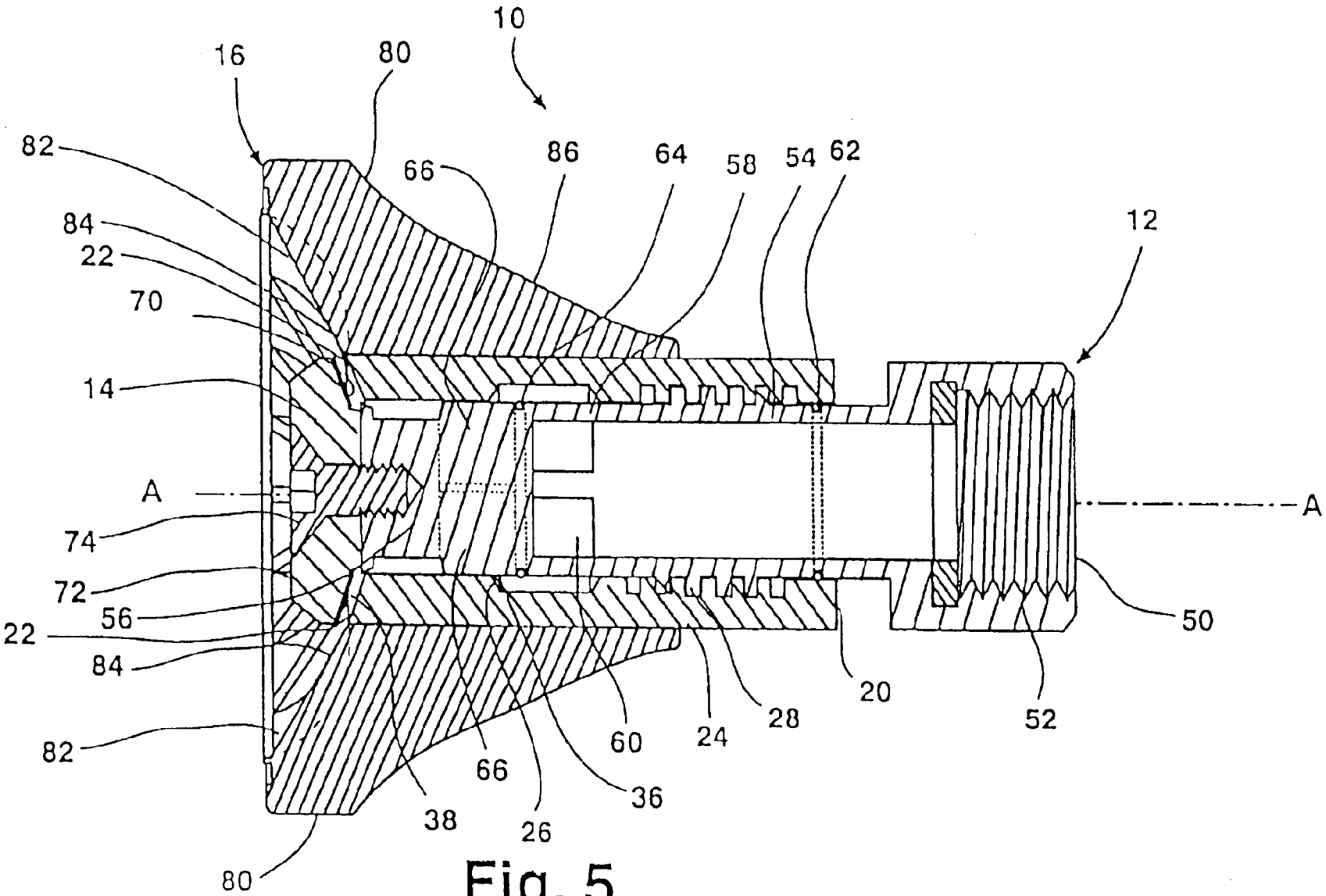
FIG. 5 is a detailed, cross-sectional side view of the embodiments of FIGS. 2 and 3 when the device is in an open position between a first closed position and a second closed position.

Referring now to FIG. 5, the embodiment of the invention shown in FIG. 4 is shown in an open position wherein the nozzle is partially open allowing material to flow through said nozzle 10. In this open position, the second sealing means 64 is no longer in a compressive leak tight engagement against the second sealing race 26. In this open position, material enters the hollow body 54 and is pushed out of the outlets 60. The seal provided by the first sealing means 62 and the first sealing race 24 prevents the back flow of material toward the first end 20 of the sleeve 16. There is no seal preventing flow of material out of the second end 22 of the sleeve 16, and thus material exits this end 22. The direction and formation of the discharge from the second end 22 is dependent upon a variety of factors including the size of the opening through which the material passes as it leaves the second end 22 of the outer sleeve 16. The dispersion pattern of the material is further affected by the shape, number, and presence of fins 66 located upon the hollow member 54.

Figure 6:
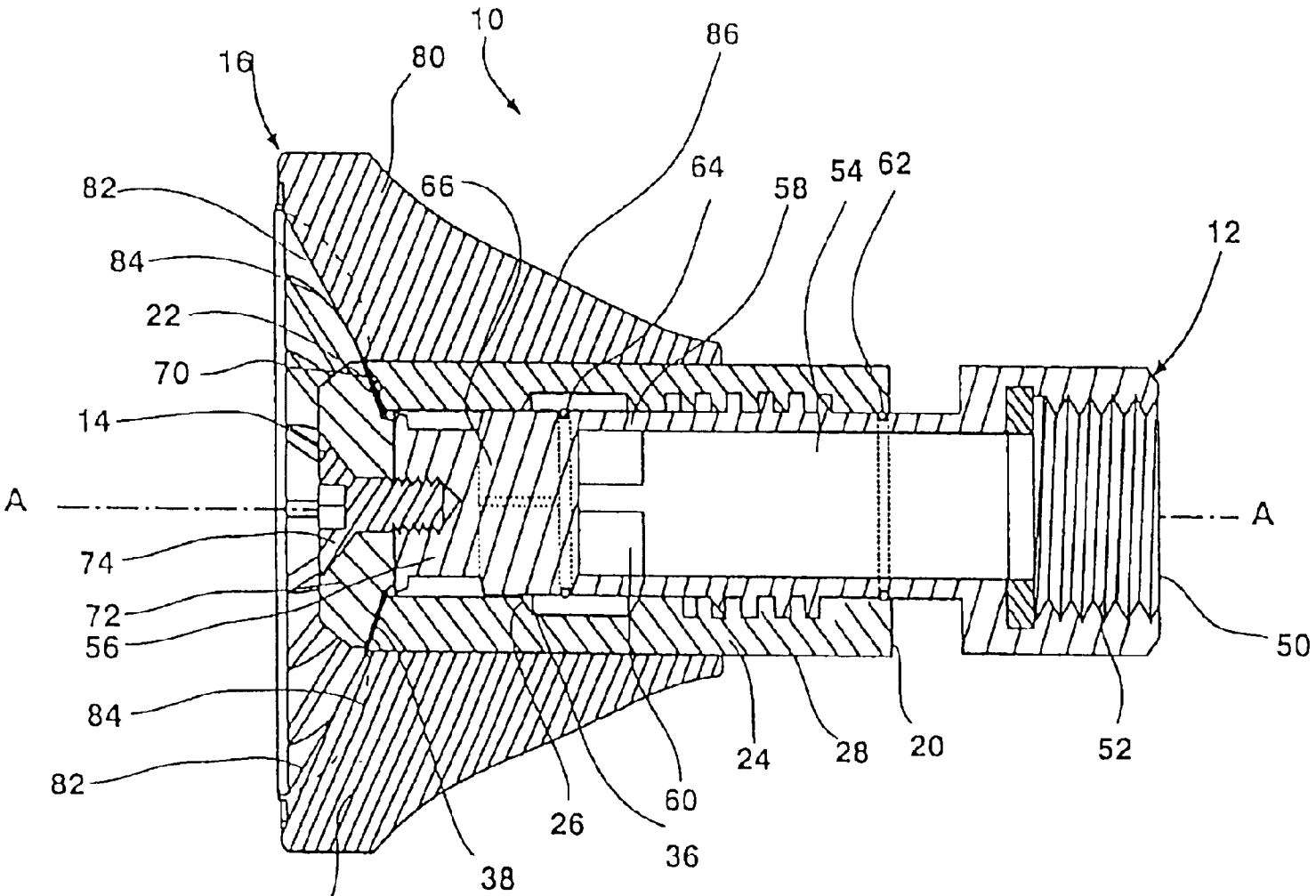
FIG. 6 is a detailed, cross-sectional side view of the embodiments of FIGS. 2 and 3 when the device is in a second closed position.

Referring now to FIG. 6, the embodiment of the invention shown in FIGS. 4 and 5 is shown in a second closed position. In this configuration, the inner conduit 12 is positioned so that the first sealing means 62 is in a compressive leak tight engagement against the first sealing race 24. This engagement prevents material from flowing back toward the receiving aperture 20 of the outer sleeve 20. The first side 70 of the end cap 14 is in a compressive leak tight engagement against the second sealing race 26. This prevents forward movement of material out of the second end 22 of the outer sleeve 16.

In this second closed position, material enters the hollow body 54 and is pushed out of the outlets 60. However, the material does not leave the nozzle 10 because of the compressive leak tight engagement provided by the first sealing means 62, the first sealing race 24, the first surface 70 of the end cap 14, and the second sealing race 26. In some embodiments, the first surface 70 of the end cap 14 may have a coating or covering that increases its ability to form a compressible leak tight engagement against the outer sleeve.

In use, a hose is attached to the first end of the inner conduit 50 by cooperation with the threaded adapter means 52. As water is forced into the first end 50 of the inner conduit 12, the water passes into the hollow body 54. The water then travels through the hollow body 54 and exits the inner conduit 12 through the outlets 60. Upon exiting the inner conduit 12, the water impacts the bore 18 of the outer sleeve 16. A seal formed by the first sealing means 62 and the first sealing race 24 prevents back flow of the water out of the outer sleeve 16 through the receiving aperture 20. The passage of water out of the discharge opening 22 is dependent upon the positioning of the inner conduit 12, the outer sleeve 16, and the end cap 14.

In the first closed position, shown in FIG. 4, the second sealing means 64 is in a leak tight engagement against the second sealing race 26 of the outer sleeve 16. This leak tight engagement between the second sealing means and the second sealing race forms a seal that prevents the flow of water out through the discharge end 22 of the outer sleeve. This seal, together with the seal formed by the first sealing means 62, and the first sealing race 24, prevents the flow of water out of the nozzle. In this first closed position, the flow of water through the nozzle is stopped. The nozzle is shut off.

As the inner conduit 12 is longitudinally moved within the outer sleeve 16 by the rotation of the threaded connection means 28, the compressive engagement between the second sealing means 64 and the second sealing race 26 is relaxed. However, the first sealing race 24 maintains a seal with the first sealing means 62. The relaxing of the seal toward the discharge opening 22 opens the nozzle and allows water to exit therethrough. This open position is shown in FIG. 5.

The amount, pressure, and velocity of the water that leaves the nozzle 10 are dependent to a certain extent upon the size of the opening through which the water will pass. When the device 10 is only partially opened, a small opening exists through which water will pass. As a general rule, this results in less water leaving the nozzle 10 over a designated period of time and a finer and wider spray pattern than when the device is more fully opened. As a general rule, the more open the nozzle 10 is, the more water can leave the nozzle 10 and the less fine and more concentated the spray pattern would be. In addition to the size of the opening through which the water will pass, the spray characteristics are affected by a variety of devices such as the fins 66 shown in this embodiment.

In this embodiment, the size of the opening through which the water leaves the nozzle 10 is increased and decreased as the inner conduit 12 and the outer sleeve 16 are adjusted between the first and second closed positions. In as much as the largest opening results at the greatest distance from the closed positions, the position of maximum flow will occur when inner conduit 12 and the outer sleeve 16 are located at a position generally equidistant between the first and second closed positions. However, as the relationship between the inner conduit 12 and the outer sleeve 16 is adjusted, the characteristics of the discharge can be varied to project the water out of the hose. For example, creating a smaller end cap 14 and enlarging the dimensions of the second sealing race 26 would provide for a more direct flow type discharge than the nozzle shown in the present embodiment. Likewise, placing a larger end cap 14 on the second end of the inner portion and varying the dimensions of the outer sleeve second end opening 22 would allow for a wider and greater spray opening.

When the first side 70 of the end cap 14 is compressively engaged against the second side 38 of the second sealing race 26, the flow of water out of the discharge opening 22 of the outer sleeve is also stopped. The existence of two spaced closed positions allows the nozzle 10 to either be opened or closed by turning the outer sleeve 16 in either of two directions in relation to the inner sleeve 12. In this embodiment, this allows the nozzle 10 to be either opened or closed by turning the outer sleeve 16 in either a clockwise or counterclockwise direction.

As the end cap 14 comes into compressive engagement with the second side 38 of the sealing race 26, the water discharged from the discharge opening 22 tends to fan out from the discharge opening 28 in a fine mist in all directions. In some applications such as the embodiment described in the parent application, which is described above and incorporated by reference, spray patterns can be produced that are so wide and fine, that they wet the person utilizing the nozzle. While in some instances this may be a desired result, in many instances this is not a desired occurrence. In the preferred embodiment, shown in FIG. 1, the nozzle head portion 80 is configured and placed about the outer conduit 16 in a manner that prevents the spray from going back on to the person utilizing the nozzle.

Figure 7:
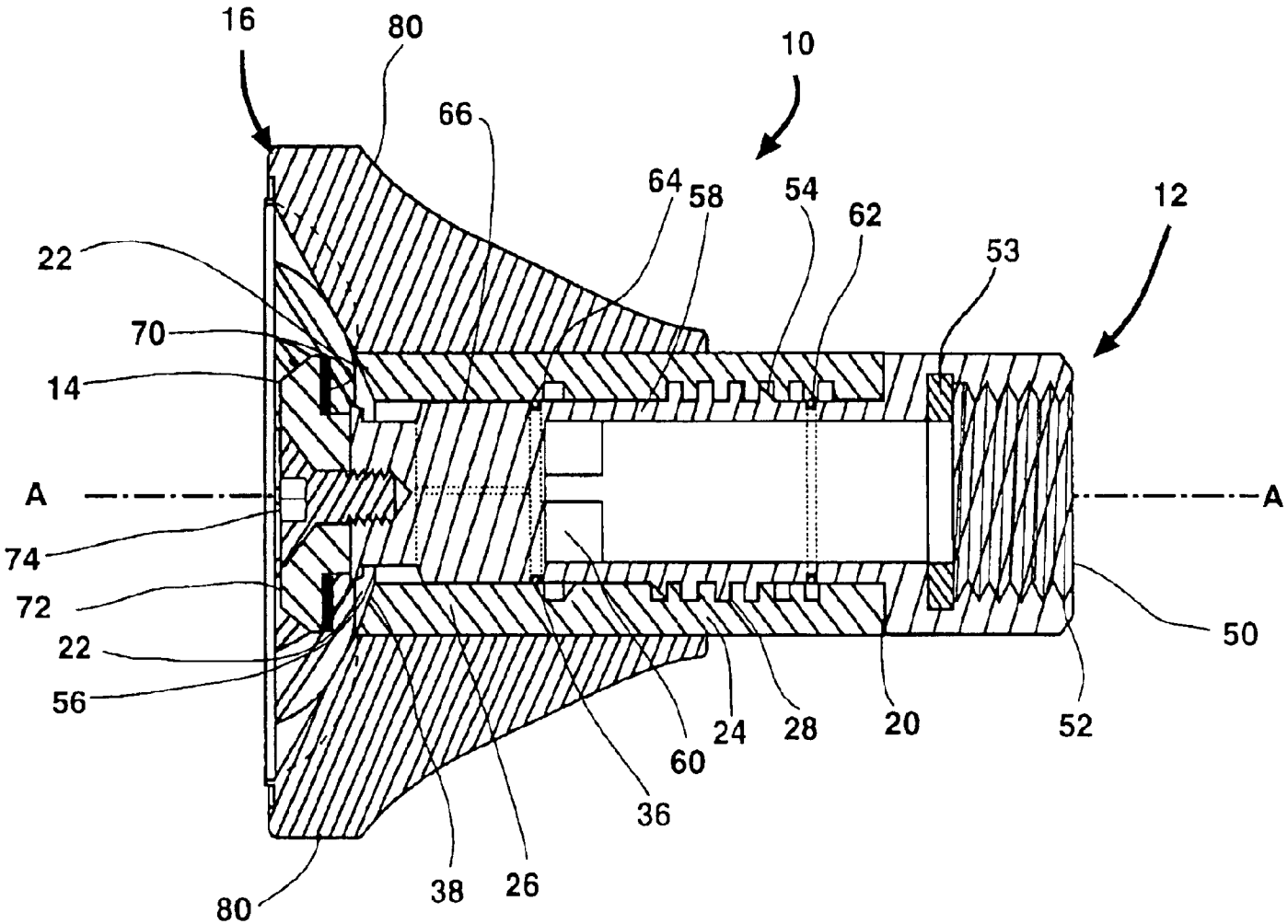
FIG. 7 is a detailed cross sectional view of a second embodiment of the present invention when the device is in a first closed position.

Referring now to FIG. 7, a detailed cross-sectional view of a second embodiment of a nozzle is shown. In this figure, the inner conduit 12 and the outer sleeve 16 are arranged in a first closed position. In this position, the hollow body portion 54 of the inner conduit 12 is located within the bore 18 of the outer sleeve 16 and the outer sleeve 16 and the inner conduit 12 are threadedly interconnected by the connection means 28. The inner conduit 12 is positioned so that the first sealing means 62 is in a compressive leak tight engagement against the first sealing race 24. This engagement prevents back flow of liquid material towards the receiving end 20 of the outer sleeve 16. The second sealing means 64 is placed in a compressive leak tight engagement against the second sealing race 26 thus preventing forward movement of material out of the discharge opening 22 of the outer sleeve 16. In this preferred embodiment, this second O-ring 64 is in a compressive engagement against the second sealing race 26. In this first closed position, liquids from the source enter the inner conduit 12 from the open first end 50, pass through the hollow body 54, and are pushed out of the outlets 60 and into the outer sleeve 16. Upon leaving the outlets 60, the liquid is prevented from flowing out of the nozzle 10 by the compressive leak tight seals provided by the combinations of the sealing means 62, 64 and the sealing races 24, 26.

Figure 8:
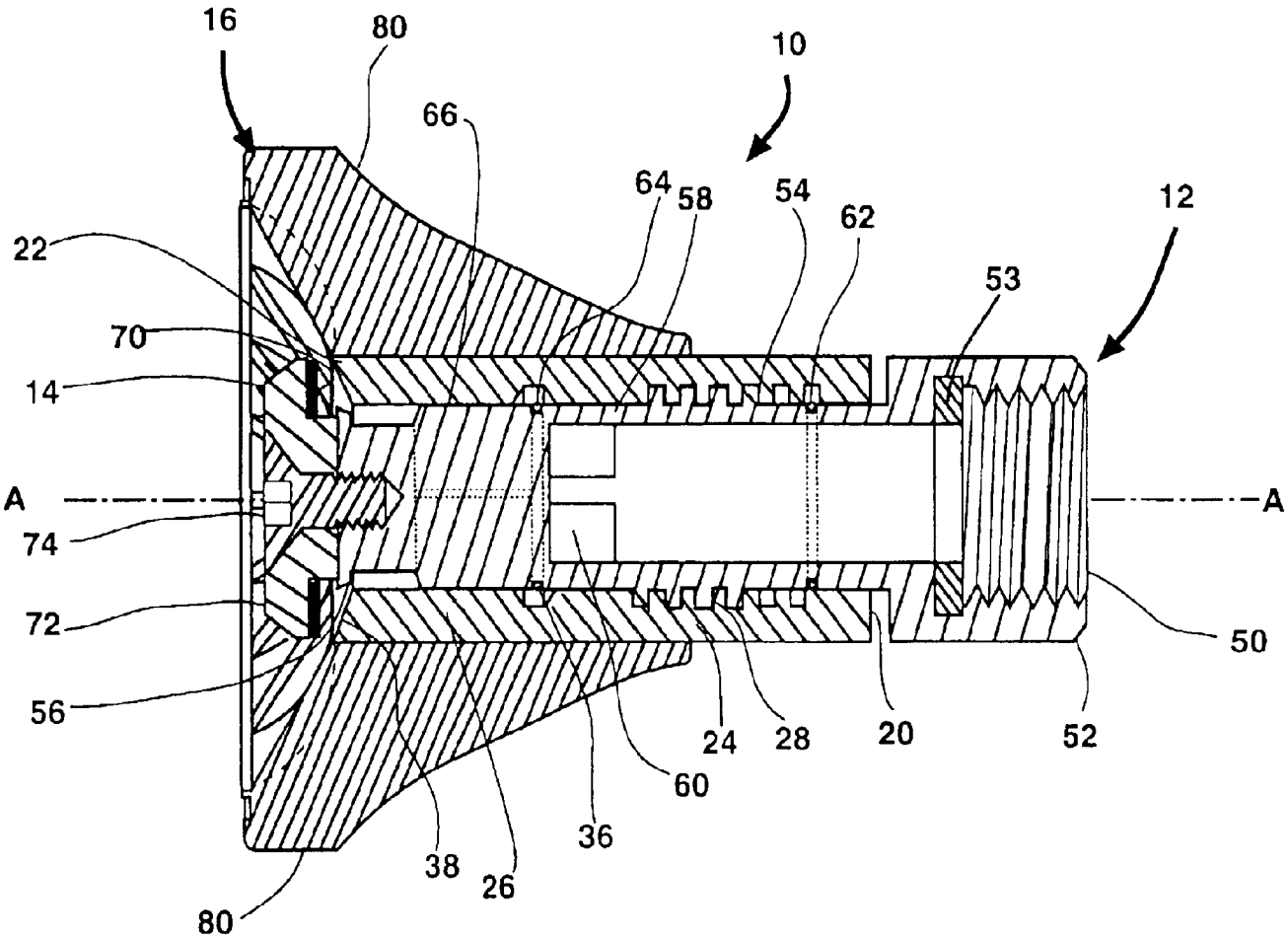
FIG. 8 is a detailed cross sectional view of the embodiment shown in FIG. 7 in an open position.

Referring now to FIG. 8, the embodiment of the invention shown in FIG. 7 is shown in an open position wherein the nozzle 10 is partially open allowing material to flow through said nozzle 10. In this open position, the second sealing means 64 is no longer in a compressive leak tight engagement against the second sealing race 26. In this second position, the entire inner conduit 12 had been moved back toward the open end 20. The second sealing means 64 is positioned within the flow chamber 40, and there is no seal that prevents the flow of water or other material out of out of the second end 22 of the nozzle. In this open position, material enters the hollow body 54 and is pushed out of the outlets 60 into the flow chamber 40. The liquid them flows around the flow chamber 40, through the dampening device shown in FIG. 3A and ultimately out of the discharge end 22 of the nozzle 10. The seal provided by the first sealing means 62 and the first sealing race 24 prevents the back flow of material toward the first end 20 of the sleeve 16. The direction and formation of the discharge from the second end 22 is dependent upon a variety of factors including the size of the opening through which the material passes as it leaves the second end 22 of the outer sleeve 16.

The movement of the inner conduit 12 within the outer conduit 16 varies the quantity of the apertures 60 that is opened within the flow chamber 40. As more of the aperture 60 is placed within the flow chamber 40, more material flows out of the discharge end of the device. As the inner conduit 12 is moved, a smaller portion of the aperture 60 remains within the flow chamber 40, and the quantity of material flowing through the discharge end of the device 22 is reduced.

Figure 9:
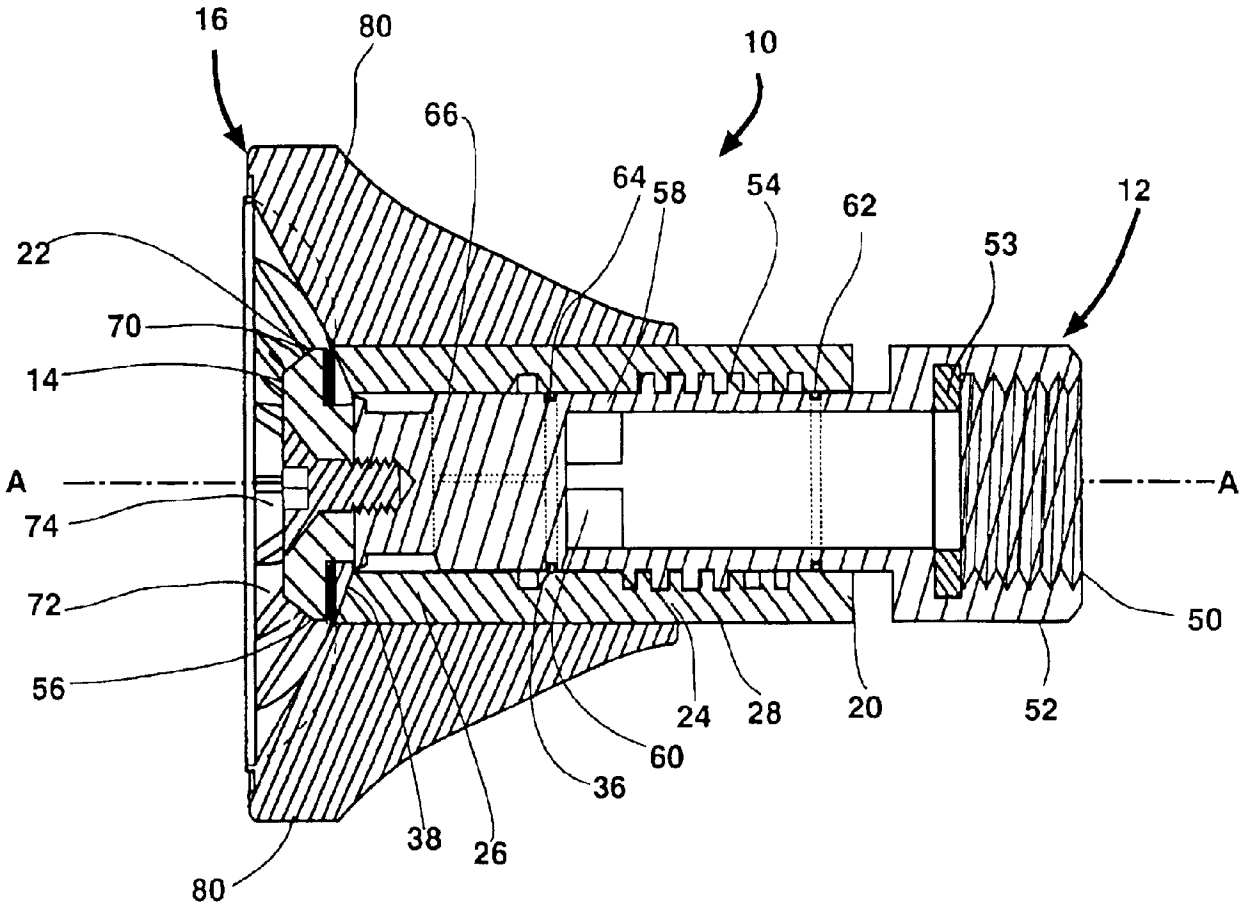
FIG. 9 is a detailed cross sectional view of the embodiment shown in FIG. 7 shown in a second closed position.

Referring now to FIG. 9, the embodiment of the invention shown in FIGS. 7 and 8 is shown in a second closed position. In this configuration, the inner conduit 12 is positioned so that the first sealing means 62 is in a compressive leak tight engagement against the first sealing race 24. This engagement prevents material from flowing back toward the receiving aperture 20 of the outer sleeve 20. The second sealing means is also in compressive leak tight engagement against the first sealing race 24. Thus with both the first and second sealing means engaged with a portion of the first sealing race 24 movement of material out of either the first end 20 or the second end 22 of the outer sleeve 16 is prevented.

In this second closed position, material enters the hollow body 54 and is pushed out of the outlets 60, against the first sealing race 24. However, the material does not leave the nozzle 10 because of the compressive leak tight engagement provided by the first sealing means 62, and the first sealing race 24 on one end of the aperture, as well as the connection between the second sealing means 62 and the first sealing race 24.

The nozzle head portion 80 is generally campanulate or bell shaped and has an inner wall 84, which defines a generally concave internal fossa. The deepest portion of this fossa is positioned at the discharge opening 22 of the outer sleeve 16. When the end cap 14 is brought towards a sealing position with the second sealing race 26, the liquid passing through the discharge opening 22 will contact the inner wall 84 of the nozzle head and be slowed. The shape of the inner wall 84 of the nozzle head 80 then redirects the spray from a lateral dispersion pattern into a forward dispersion pattern.

As the water moves in the forward dispersion pattern, the droplets of the liquid begin to conglomerate and the spray condenses into to a spray hood that is directed away from the nozzle head portion 80. As inner and outer portions of the nozzle continue to close, the pressure of the water leaving the hose decreases as the volume is lessened. The small droplets conglomerate into larger droplets, which come together into a spray hood and fall onto the ground generally in front of the person utilizing the device.

Depending upon the individual necessities of the user, a variety of modifications to this basic structure can be utilized. These would include combining the nozzle with other traditional type nozzle head features such as are commonly known in the prior art. In the preferred embodiment, the internal wall 84 that defines the fossa has a variety of regularly spaced projections 82 attached to it. These projections 82 break up the spray hood and cause portions of the spray hood to conglomerate more quickly so as to cause the spray pattern that is moving in a forward direction to condense more quickly and effectively. These projections also increase the surface area of the inner wall 84 that the water is able to contact thus slowing the water as it disperses while maintaining narrowing the spray pattern. The projections also direct these actions and are then able to project the liquid forward in a desired pattern, thus allowing the spray droplets to conglomerate more rapidly.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A dual closure nozzle comprising:

an outer sleeve having a central longitudinal bore for receiving in longitudinally movable interconnection an inner conduit, said outer sleeve having, in sequence, a receiving aperture for receiving said inner conduit, a fluid material flow chamber defined within said central bore and at least one discharge opening configured to allow passage of a fluid material out from said fluid material flow chamber of said outer sleeve, said outer sleeve further being longitudinally displaceable along said inner conduit from a first closed position through an intermediate open position to a second closed position, and connected to a nozzle head, said nozzle head having an inner wall defining an inner fossa, said nozzle head configured to connect with said outer sleeve near said discharge opening, and to direct a liquid spray into a desired pattern;

said inner conduit configured for positioning within said outer sleeve, said inner conduit having an inlet opening configured for the passage of fluid material from an external source into said inner conduit and at least one outlet opening configured for the passage of fluid material out from said inner conduit and into said fluid flow chamber of said outer sleeve;

sealing means disposed between said outer sleeve and said inner conduit, said sealing means configured to prevent the passage of fluid material out from said outer sleeve and through said discharge opening when said outer sleeve is longitudinally displaced in said first closed position, to prevent the passage of fluid material out of said outer sleeve when said outer sleeve is longitudinally displaced in said second closed position, and to permit the passage of fluid material out from said outer sleeve and through said discharge opening when said outer sleeve is longitudinally disposed in said intermediate position.

2. The dual closure nozzle of claim 1 wherein said sealing means further comprises:

a first sealing race disposed within said central bore of the outer sleeve between said receiving aperture and said fluid material flow chamber;

a second sealing race disposed within said central bore between said fluid material flow chamber and said discharge outlet; and a first sealing ring circumvolving said inner conduit in a position between said outlet opening of said inner conduit and said discharge opening of said outer sleeve, said sealing ring configured for fluid tight engagement with said second sealing race when said outer sleeve is positioned at said first closed position, and for fluid tight engagement with said first sealing race when said outer sleeve is positioned at said second closed position, said sealing ring also configured to allow passage of fluid material out of said discharge opening when said outer sleeve is positioned at said intermediate position.

3. The dual closure nozzle of claim 2 wherein said sealing means are O-rings configured for placement about said inner conduit.

4. The dual closure nozzle of claim 2 wherein said nozzle head is configured to connect with said outer sleeve in a position wherein said discharge opening is positioned at said deepest portion of said fossa.

5. The dual closure nozzle of claim 2 wherein said inner surface has at least one projection extending from said inner surface.

6. The dual closure nozzle of claim 2 wherein said inner surface comprises a series of projections extending from said inner surface.

* * * * *